US005926964A

United States Patent [19]

Korapaty

[11] Patent Number: 5,926,964

[45] **Date of Patent: *Jul. 27, 1999**

[54] RELIABLE SCOPE MOUNT

[76] Inventor: Bob Korapaty, 5243 Grace Ave., Brownsville, Tex. 78521

[ * ] Notice: This patent is subject to a terminal disclaimer.

[21] Appl. No.: 08/996,336

[22] Filed: Dec. 22, 1997

[51] Int. Cl.[6] ..... F41G 1/387

[52] U.S. Cl. ..... 33/250; 42/101

[58] Field of Search ..... 33/250, 252, 254, 33/257, 245

[56] References Cited

U.S. PATENT DOCUMENTS 5,784,822 7/1998 Korapaty ..... 42/101

*Primary Examiner*—Charles T. Jordan
*Assistant Examiner*—Denise J Buckley
*Attorney, Agent, or Firm*—Michael I. Kroll

[57] ABSTRACT

An unified barrel scope mount for retaining a scope on one of a rifle and pistol. The unified barrel scope mount includes a mounting section for clamping the unified barrel scope mount to one of the rifle and pistol including a recess formed therein for clamping to a connector on the one of the rifle and pistol. A scope mounting device is provided for retaining a scope thereon and a mid section is connected between the mounting section and the scope mounting device. The mid section includes a slot extending from the recess in the mounting section and at least partially therethrough; a first vertical side extending perpendicular to the slot; and a second diagonal side extending perpendicular to the slot. The unified barrel scope mount is movable along a length of the connector on the one of the rifle and pistol and is connectable in one a first position and second position. In the first position the second diagonal side can extend over a bolt of the one of the rifle and pistol and in the second position the second diagonal side extends at least partially over a shell ejection port of the one of the rifle and pistol. In the first and second positions the diagonal side allows unobstructed movement of both the bolt and unobstructed ejection of shells from the ejection port.

20 Claims, 5 Drawing Sheets

RELIABLE SCOPE MOUNT

BACKGROUND OF THE INVENTION

1. Field of the Invention

The instant invention relates generally to scope mounts for bolt and non bolt action rifles and pistols and, more specifically, to a unified scope mount attachable to dovetail or barrel mount hand guns or long guns including but not limited to revolvers, automatics and bolt and non bolt action rifles and pistols for securing a scope of any diameter thereto at any point along the length of the barrel.

2. Description of the Prior Art

Numerous scope mounts for rifles and pistols have been provided in the prior art. Such mounts have normally included numerous parts which act to complicate their use and are not reliable in their operation due to the interaction of the numerous parts. These prior art devices also do not provide for use with both long and standard eye relief scope types. Furthermore, prior art scope mounts for rifles and pistols are both difficult to position and install on a rifle or pistol and allow restricted movement of the scope along the length of the barrel thereby not fully accommodating the size or physical dimensions of all possible users. While these units may be suitable for the particular purpose to which they address, they would not be as suitable for the purposes of the present invention as heretofore described.

In view of the problems associated with prior art scope mounts for rifles and pistols, a need exists for a scope mount which is easy to use, is adapted for use with both long and standard eye relief scope types, is readily installed and positioned on a rifle or pistol and is adjustable for movement over a greater range of the length of the barrel.

SUMMARY OF THE INVENTION

The instant invention relates generally to scope mounts for rifles and pistols and, more specifically, to a unified scope mount attachable to dovetail or barrel mount hand guns or long guns including but not limited to revolvers, automatics and bolt and non bolt action rifles and pistols for securing a scope of any diameter thereto at any point along the length of the barrel.

A primary object of the present invention is to provide a unified barrel scope mount for rifles and pistols that will overcome the shortcomings of the prior art devices.

Another object of the present invention is to provide a unified barrel scope mount for rifles and pistols including a mounting element for adjustably connecting a scope to the rifle or pistol.

A yet further object of the present invention is to provide a unified barrel scope mount for rifles and pistols which is easily positioned and installed on the rifle or pistol.

A still further object of the present invention is to provide a unified barrel scope mount for rifles and pistols that may be used with both long and standard eye relief scopes.

An additional object of the present invention is to provide a unified barrel scope mount for rifles and pistols which does not interfere with both movement of the bolt and ejection of used shells.

A still further object of the present invention is to provide a unified barrel scope mount for rifles and pistols wherein the scope can be adjusted to sit at any point along the dovetail or barrel mount.

An even further object of the present invention is to provide an unified barrel scope mount for rifles and pistols which may be used with top eject featured fire arms.

A further object of the present invention is to provide an unified barrel scope mount for rifles and pistols that is simple and easy to use.

A still further object of the present invention is to provide an unified barrel scope mount for rifles and pistols that is economical in cost to manufacture.

Additional objects of the present invention will appear as the description proceeds.

A unified barrel scope mount for retaining a scope on one of a rifle and pistol is disclosed by the present invention. The unified barrel scope mount includes a mounting section for clamping the unified barrel scope mount to one of the rifle and pistol including a recess formed therein for clamping to a connector on the one of the rifle and pistol. A scope mounting device is provided for retaining a scope thereon and a mid section is connected between the mounting section and the scope mounting device. The mid section includes a slot extending from the recess in the mounting section and at least partially therethrough; a first vertical side extending perpendicular to the slot; and a second diagonal side extending perpendicular to the slot. The unified barrel scope mount is movable along a length of the connector on the one of the rifle and pistol and is connectable in one of a first position and second position. In the first position the second diagonal side extends over a bolt of the one of the rifle and pistol and in the second position the second diagonal side extends at least partially over a shell ejection port of the one of the rifle and pistol. In the first position the diagonal side allows unobstructed movement of the bolt and ejection of shells. In the second position the diagonal side allows unobstructed movement of the bolt and ejection of shells from the ejection port. The two positions provide the unique capability of allowing eye relief greater than conventional prior art scope mounts.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of a rifle implementing the unified barrel scope mount of the present invention;

FIG. 1*a* is a perspective view of a rifle implementing the unified barrel scope mount of the present invention in a first position extending above but not blocking movement of the bolt while also not blocking the ejection port providing the unique capability of allowing eye relief greater than that of conventional prior art scope mounts;

FIG. 1*b* is a perspective view of a rifle implementing the unified barrel scope mount of the present invention in a second position extending above but not blocking the ejection port while also not blocking movement of the bolt providing the unique capability of allowing eye relief greater than that of conventional prior art scope mounts;

LIST OF REFERENCE NUMBERS

Figure 1:
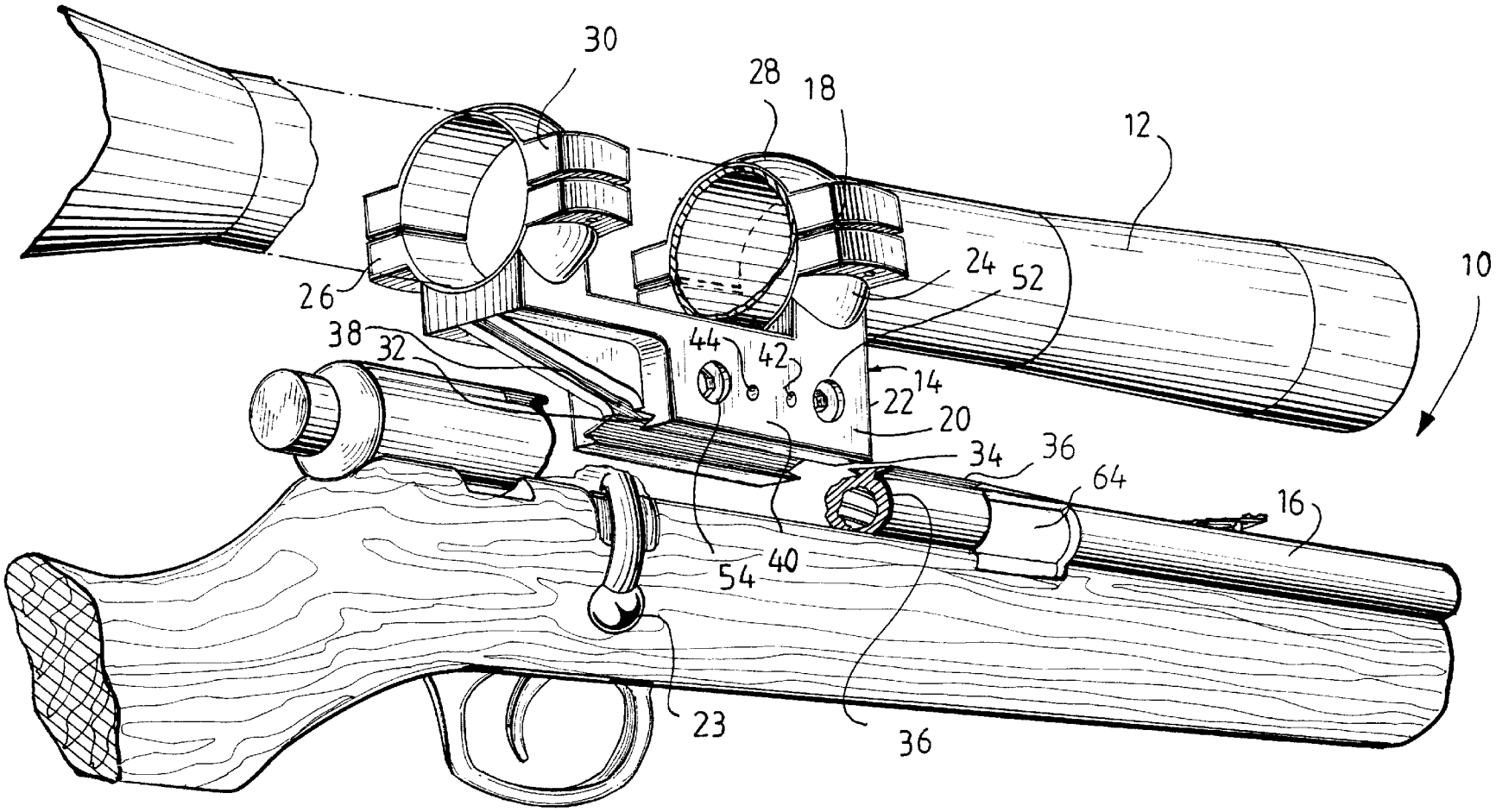

Turning now descriptively to the drawings, in which similar reference characters denote similar elements throughout the several views, the Figures illustrate the unified barrel scope mount for rifles and pistols of the present invention. With regard to the reference numerals used, the following numbering is used throughout the various drawing figures.

10 rifle
12 scope
14 unified barrel scope mount
16 clamping section of the rifle or barrel
18 scope mount section of the unified barrel scope mount
20 mounting section of the unified barrel scope mount
22 mid section of unified barrel scope mount
23 bolt on rifle
24 first scope receiving section of the unified barrel scope mount
26 second scope receiving section of the unified barrel scope mount
28 first scope clamping section of the unified barrel scope mount
30 second scope clamping section of the unified barrel scope mount
32 dovetail recess
34 bottom side of mounting section
36 dovetail connector
38 spreader slot
40 first side of the mid section
42 first spreader hole
44 second spreader hole
45 first wall of spreader slot
46 spreader screw
47 second wall of spreader slot
48 head section of spreader screw
50 threaded section of spreader screw
52 first clamping hole
54 second clamping hole
56 flat side
58 angled side
60 butt
62 fore end of stock
64 ejection port
66 first recess extending through scope clamping section
68 second recess extending through scope clamping section
70 first recess extending through scope receiving section
72 second recess extending through scope receiving section
74 scope clamping screw
76 shell
78 rounded recess
80 first beveled side
82 second beveled side
86 arrow indicating rotational movement of unified barrel scope mount
88 arrow indicating rotational movement of scope

DETAILED DESCRIPTION OF THE PREFERRED EMBODIMENTS

Turning now descriptively to the drawings, in which similar reference characters denote similar elements throughout the several views, the figures illustrate a unified barrel scope mount for use with any type of hand gun or long gun including but not limited to revolvers, automatics and bolt and non bolt action rifles and pistols. A rifle implementing the unified barrel scope mount of the present invention is indicated generally by the numeral 10.

The rifle 10 in FIGS. 1–5 illustrates a dovetail assembly for connecting a unified barrel scope mount 14 in accordance with the present invention thereto. The rifle 10 as shown in the figures includes a scope 12 mounted thereon via the unified barrel scope mount 14 of the present invention. The unified barrel scope mount 14 and scope 12 are mounted to a clamping section 16 of the rifle 10. The unified barrel scope mount 14 includes a scope mount section 18, a mounting section 20 and a mid section 22 connecting the scope mount section 18 and the mounting section 20.

The scope mount section 18 includes first and second scope receiving sections 24 and 26, respectively. The first and second scope receiving sections 24 and 26 are shaped to conform with and comfortably receive the scope 12 therein. The scope mount section 18 also includes first and second scope clamping portions 28 and 30, respectively. The first and second scope clamping portions 28 and 30 are removably connected to the first and second scope receiving sections 24 and 26 and act to securely retain the scope 12 therebetween.

The mounting section 20 is defined by a dovetail shaped recess 32 extending from and along a base side 34 thereof. The recess 32 is shaped to mate with a dovetail connector 36 extending from the clamping section 16 of the rifle 10. The recess 32 extends along a length of the mounting section 20. A spreader slot 38 extends from the recess 32 and into the mid section 22 of the unified barrel scope mount 14 allowing the recess 32 to be expanded for placement on the dovetail connector 36.

Figure 2:
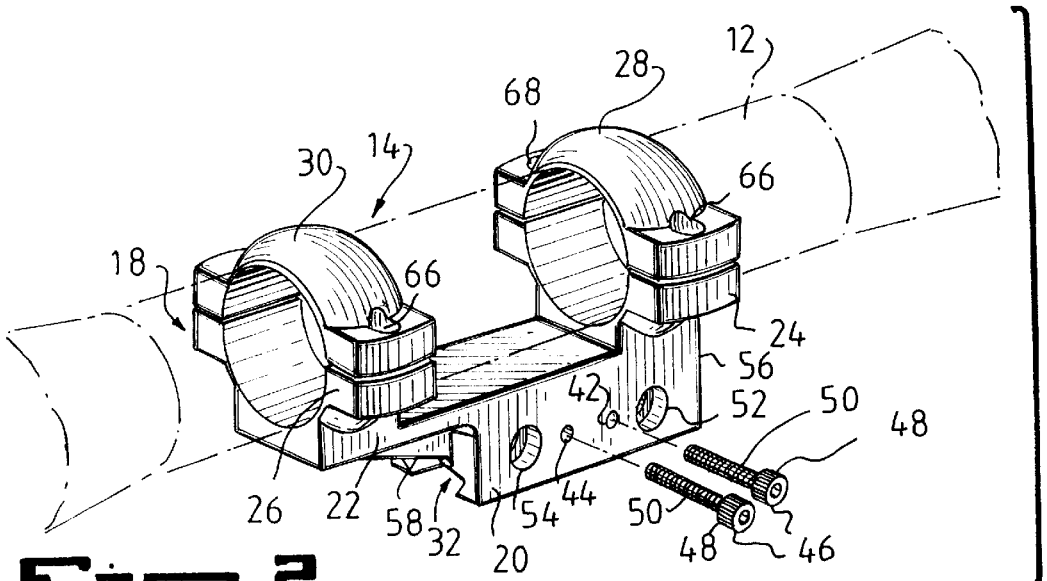
FIG. 2 is an enlarged perspective view of the unified barrel scope mount of the present invention with a scope shown in dashed lines mounted therein.
Figure 4:
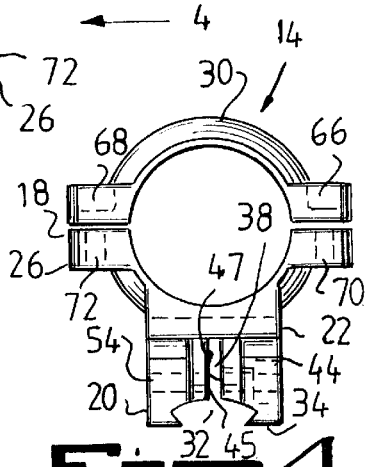
FIG. 4 is front view of the unified barrel scope mount of the present invention.

The mid section 22 is connected between the scope mount section 18 and the mounting section 20 with the spreader slot 38 extending at least partially therein. On a first side 40 of the mid section 22 and extending partially through the midsection 22 so as to open into the spreader slot 38 are first and second spreader holes 42 and 44. The first and second spreader holes 42 and 44 each include a thread (not shown) spiraling therearound for mating with a spreader screw 46 as illustrated in FIG. 2. When the unified barrel scope mount 14 is positioned on the rifle 10, the spreader screws 46, each including a head section 48 and a threaded section 50 including a thread spiraling therearound, may be inserted within the first and second spreader holes 42 and 44. The spreader screws 46 engage the thread within the first and second spreader holes 42 and 44, respectively. The spreader screws 46 are continually turned causing them to extend further within the first and second spreader holes 42 and 44. This causes the spreader screws 46 to extend through their respective spreader holes 42 and 44 until they engage a first wall 45 on the opposing side of the spreader slot 38. The first and second walls 45 and 47 defining the spreader slot 38 are illustrated in FIG. 4. As the spreader screws 46 are turned to extend further into their respective spreader holes 42 and 44 they exert a force against the first wall 45 forcing the first wall 45 away from the second wall 47 to widen and thus increase the size of the spreader slot 38 for mounting the unified barrel scope mount 14 on the connector 36 of the clamping section 16 of the rifle 10.

Positioned on either side of the first and second spreader holes 42 and 44 are first and second clamping holes 52 and 54, each including a thread (not shown) spiraling therein. The first and second clamping holes 52 and 54 extend completely through the mid section 22 passing through the spreader slot 38 as is illustrated in FIG. 4. Once the unified barrel scope mount 14 is mounted to the connector 36 of the clamping section 16 of the rifle 10, the spreader screws 46 are removed from the spreader holes 42 and 44 and inserted into the first and second clamping holes 52 and 54, respectively. The spreader screws 46 are caused to engage the thread therein during a clamping mode in which the unified barrel scope mount 14 is secured to the rifle 10. As the spreader screws 46 are turned to extend further into the clamping holes 52 and 54 they cross through the spreader slot 38 and engage the thread within the respective clamping hole on the opposing side of the spreader slot 38. As the spreader screws 46 are caused to extend further through the clamping holes 52 and 54, the first and second walls 45 and 47 of the spreader slot 38 are forced towards each other thereby reducing the size of the spreader slot 38 and securing the unified barrel scope mount 14 to the clamping section 16 of the rifle 10.

The use of the screws 46 for clamping and unclamping of the unified barrel scope mount 14 of the present invention to the rifle 10 is for purposes of illustration only. It is to be realized that the spreading and clamping of the unified barrel scope mount 14 may be achieved by any alternate means such as a camming device (not shown), a toggle (not shown) or any other device as long as it achieves the purpose of spreading the spreader slot and releasably clamps the unified barrel scope mount 14 to the rifle 10.

The mid section 22 includes a flat side 56 and an angled side 58 both extending perpendicular to the spreader slot 38. The angled side 58 extends at a diagonal from a point directly above the mounting section 20 and away from the unified barrel scope mount 14 towards the scope mounting section 18. The first scope receiving section 24 is positioned above the flat side 56 and the second scope receiving section 26 is positioned at an end of the angled side 58.

Figures 1A, 1B:
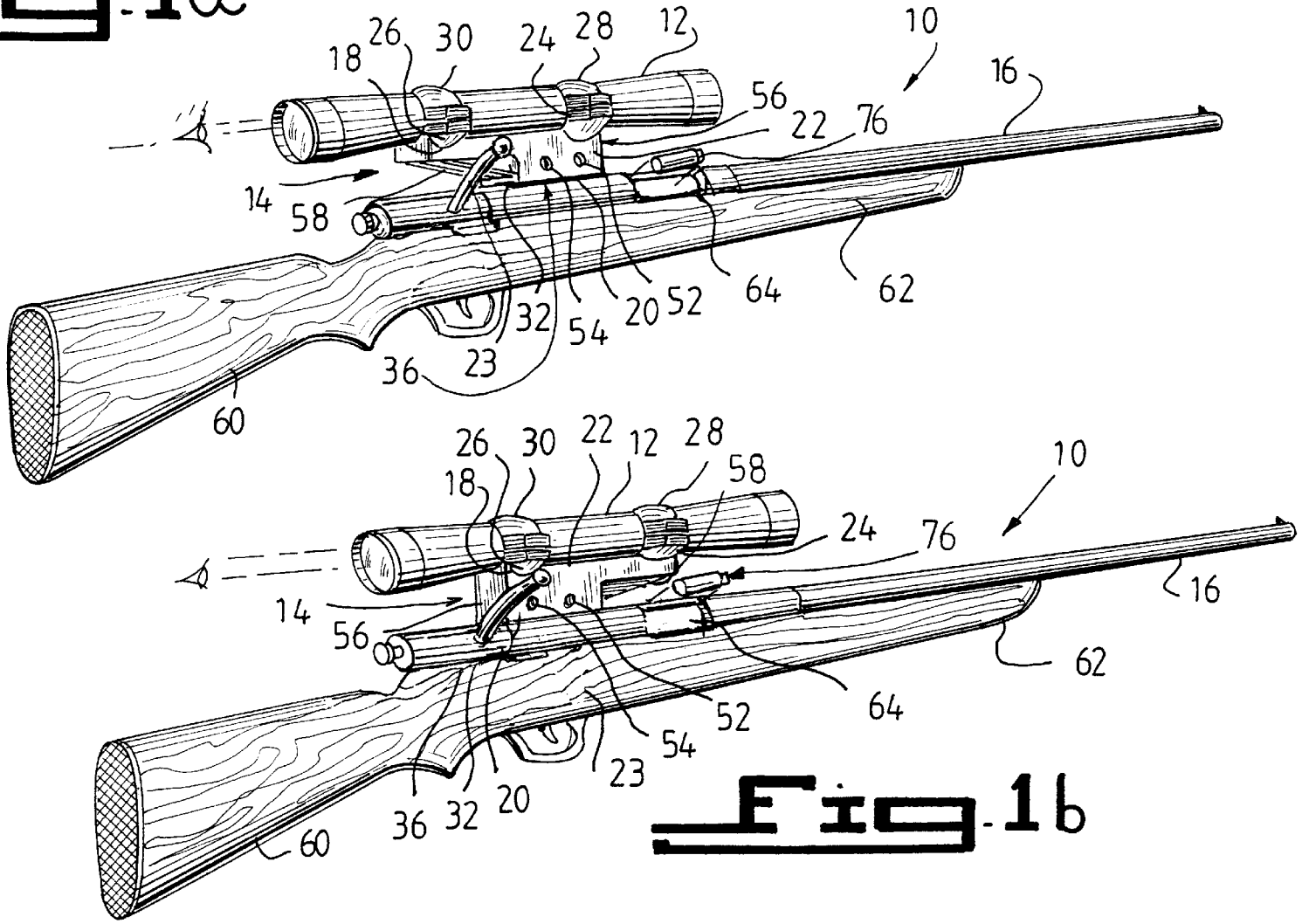

The unified barrel scope mount 14 can be mounted in a first position in which the scope 12 is positioned closer to a butt section 60 of the rifle 10 as illustrated in FIG. 1*a* or in a second position in which the scope 12 is seated further along the barrel 62 of the rifle 10 as illustrated in FIG. 1*b*. The unified barrel scope mount 14 can move along the connector 36 to position the scope 12 at any point between the extremes of the first and second positions.

As shown in FIG. 1*a*, the unified barrel scope mount 14 is mounted on the rifle 10 such that the angled side 58 extends towards the butt 60 of the rifle 10. In this position, the angled side 58 may be positioned so as to extend over the bolt 23 while not restricting the movement of the bolt 23. As the second scope receiving section 26 is positioned on the extended end of the angled side 58, the scope 12 may be positioned over the bolt 23 and at least partially over the butt 60. This allows a smaller person using the rifle 10 to comfortably place their eye up to the scope 12.

As shown in FIG. 1*b*, the unified barrel scope mount 14 is mounted on the rifle 10 such that the angled side 58 extends over the barrel 16 of the rifle 10. In this position, the angled side 58 may be positioned so as to extend over the ejection port 64 thereby not restricting the ejection of shells therefrom. As the second scope receiving section 26 is positioned on the extended end of the angled side 58, it is able to position the scope 12 over the ejection port 64 further out over the barrel of the rifle 10. This allows a larger person using the rifle 10 to comfortably place their eye up to the scope 12 without restricting them from extending their limbs. By allowing the unified barrel scope mount 14 to be mounted in either the first or second position or anywhere in between the extremes of these positions, the range in which the scope 12 can be positioned is greatly increased thereby providing a user with a more comfortable fit and allowing a wider range of users of different bodily dimensions.

Figure 3:
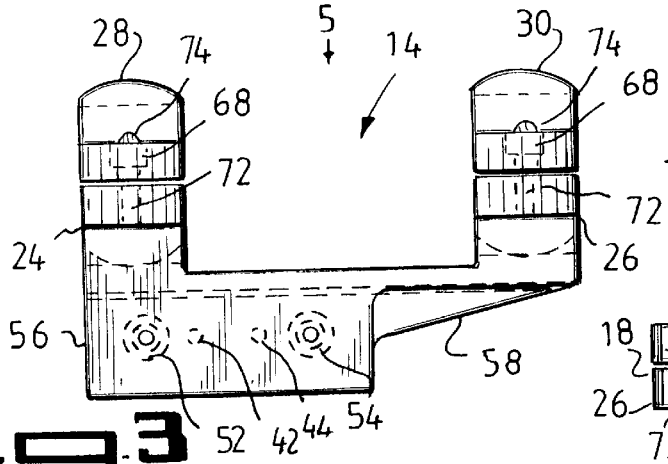
FIG. 3 is a right side view of the unified barrel scope mount of the present invention.

FIG. 2 illustrates the unified barrel scope mount 14 of the present invention prior to mounting on a rifle 10 and having a scope 12 shown in phantom mounted thereto. This figure illustrates the spreader screws 46 including a head section 48 and a threaded portion 50 being directed towards the spreader holes 42 and 44 for use in expanding the spreader slot 38 as described above. Once the spreader slot 38 is expanded to a sufficient size, the mounting section 20 is positioned on the connector 36 and the spreader screws 46 are removed. The spreader screws 46 are then positioned within the clamping holes 52 and 54 for use in securing the unified barrel scope mount 14 to the rifle 10. As is also depicted in this figure, the first and second scope clamping portions 28 and 30 each include first and second recesses 66 and 68 on either side thereof which match with respective identical first and second recesses 70 and 72 extending through the first and second scope receiving portions 24 and 26. The first and second recesses 70 and 72 extending through the first and second scope receiving portions 24 and 26 are illustrated in FIGS. 3 and 4. A scope clamping screw 74 is inserted into the first and second recesses 66 and 68 of both the first and second scope clamping portions 28 and 30 and extends through the matching recesses 70 and 72 extending through the first and second scope receiving portions 24 and 26 to secure the scope 12 therebetween. The mating of the recesses 66 and 68 with the corresponding recesses 70 and 72 is clearly shown in FIGS. 3 and 4.

Figure 5:
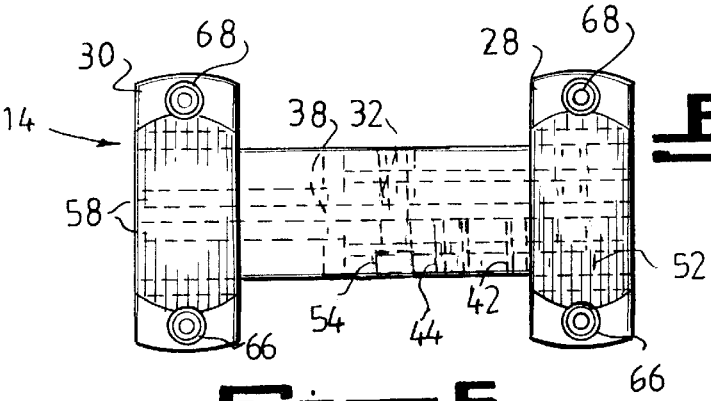
FIG. 5 is a top view of the unified barrel scope mount of the present invention.
Figure 6:
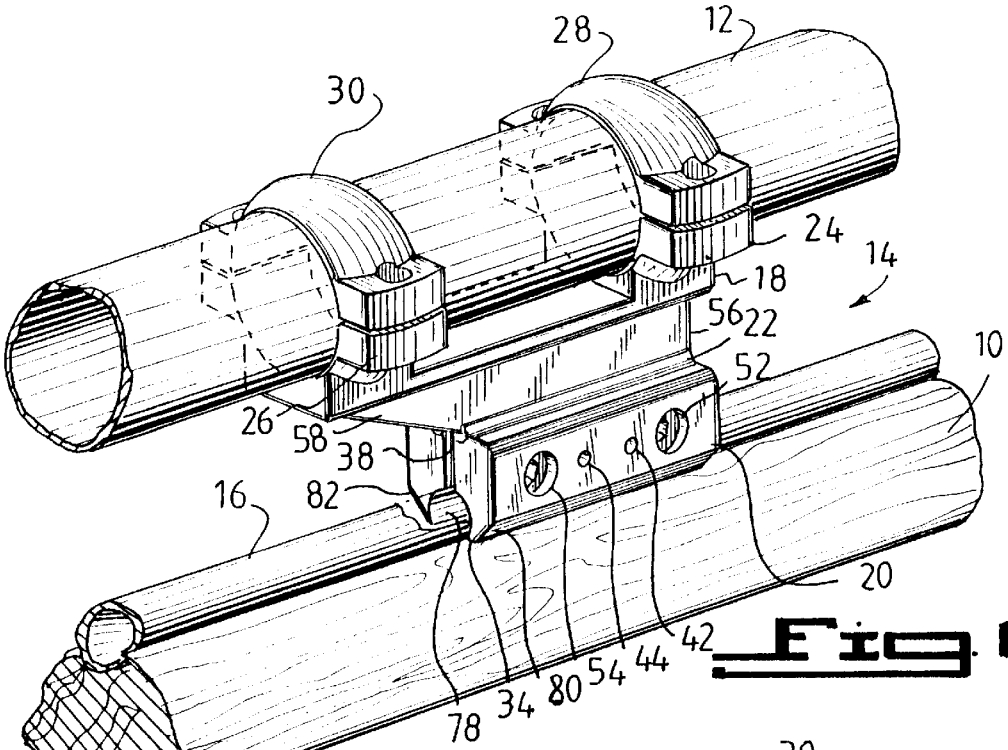
FIG. 6 is a right side perspective view of the unified barrel scope mount of the present invention including a semicircular mount and connected in the first position.
Figure 7:
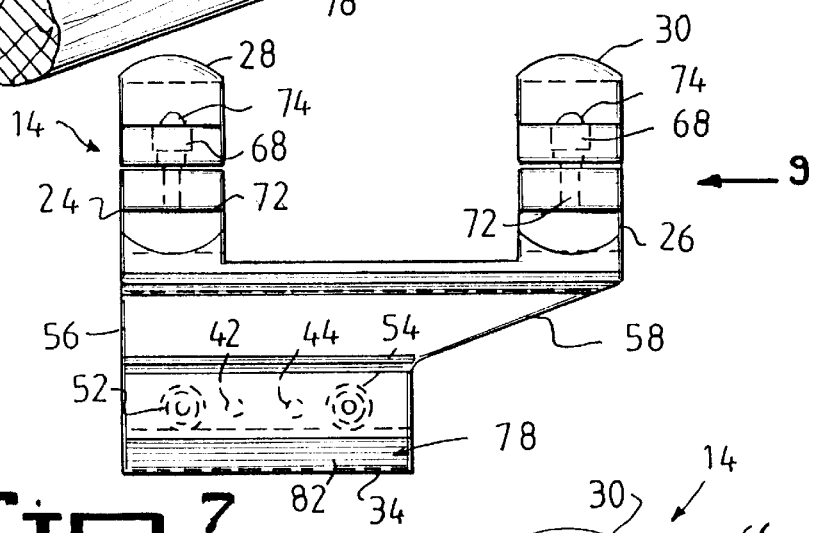
FIG. 7 is a left side view of the unified barrel scope mount of the present invention as shown in FIG. 6.
Figure 8:
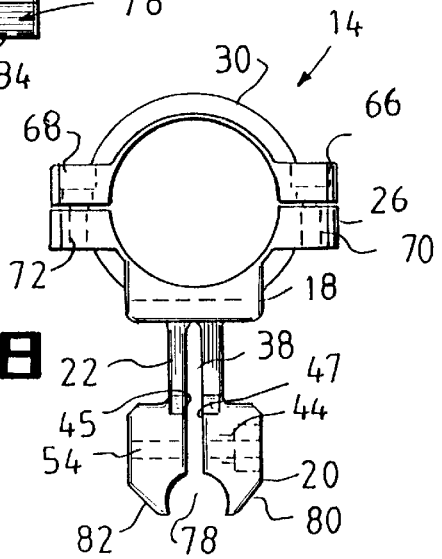
FIG. 8 is a front side view of the unified barrel scope mount of the present invention as shown in FIG. 6.
Figure 9:
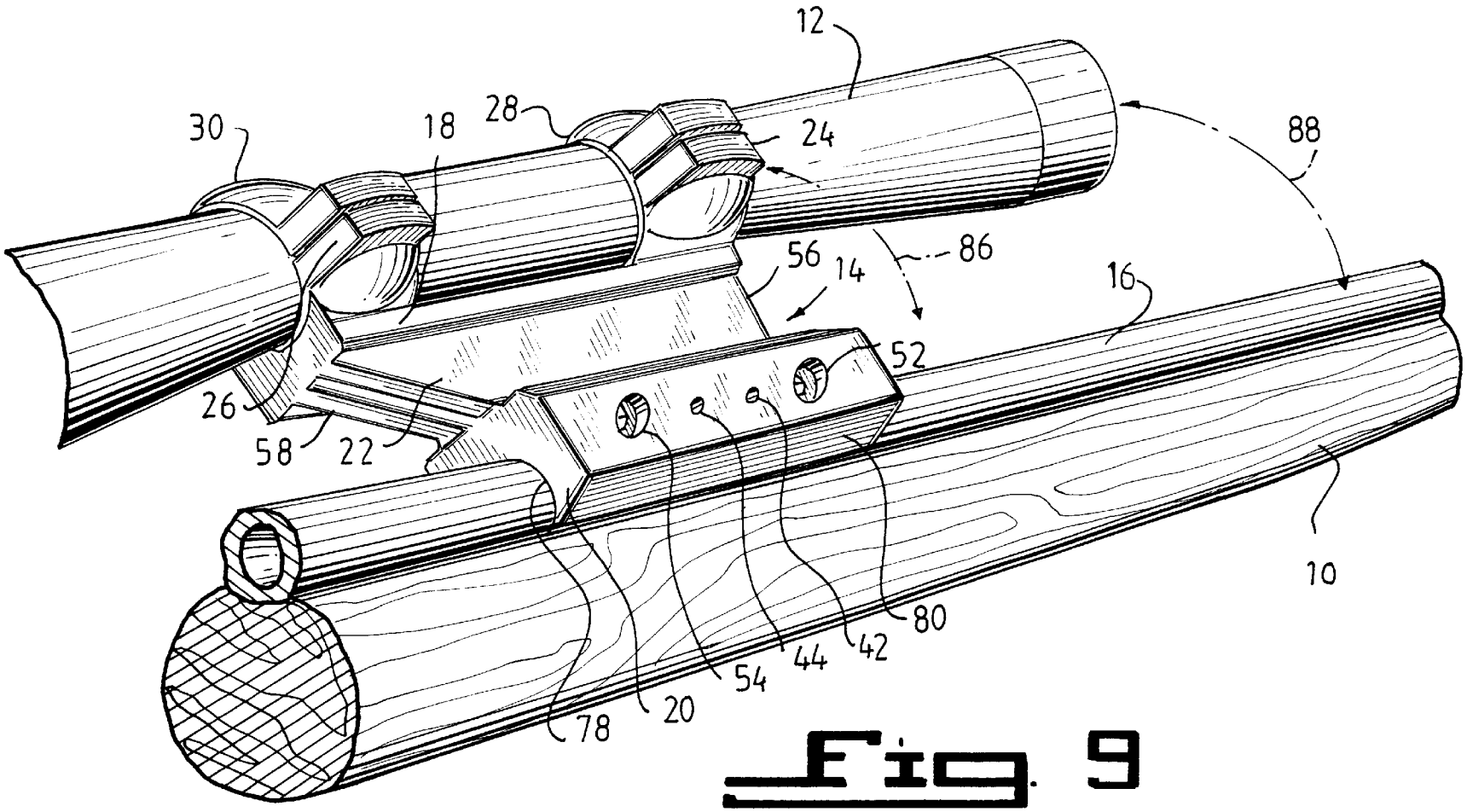
FIG. 9 is a perspective view of the unified barrel scope mount of the present invention as shown in FIG. 6 and connected in the second position.

FIG. 5 illustrates a top view of the unified barrel scope mount 14 of the present invention showing all recesses extending therein in dashed lines. As can be seen from this figure, the dovetail recess 32 is formed in the mounting section 20 of the unified barrel scope mount 14. Extending from the dovetail recess 32 and into the mid section 22 is the spreader slot 38. The spreader slot 38 is defined by first and second side walls 45 and 47. As is shown in dashed lines, the clamping holes 52 and 54 extend on either side of the spreader slot 38 whereby the spreader screws 46 are able to extend through the spreader slot 38 to engage the respective clamping hole on either side thereof. The spreader holes 42 and 44 only extend through one side of the mid section 22 and end at the second wall 47. When the spreader screws 46 are inserted therein they are caused to extend through the second wall 47 and the spreader slot 38 to contact the first side 45. This figure also illustrates the first and second recesses 70 and 72 extending through the first and second scope receiving portions 24 and 26 and the first and second recesses 66 and 68 extending through the first and second scope clamping portions 28 and 30 for clamping the scope 12 in the scope mounting section 18.

FIG. 1*b* illustrates the unified barrel scope mount 14 in the second position wherein the angled side 58 of the mid section 22 is in the second position extending over the ejection port 64. As can be seen from this figure, the unified barrel scope mount 14 allows the scope 12 mounted thereto to extend out over the barrel 16 of the rifle 10. As the angled side 58 extends over the ejection port 64, the unified barrel scope mount 14 may be mounted at a point wherein the base of the angled side 58 is directly adjacent the ejection port 64. With the unified barrel scope mount 14 in this position shells 76 are not obstructed from leaving the rifle 10 through the ejection port 64.

FIGS. 6–9 illustrate the unified barrel scope mount 14 including a rounded, semicircular recess 78 having beveled sides 80 and 82 for use in mounting the unified barrel scope mount 14 to the barrel 16 of the rifle 10. The unified barrel scope mount 14 is otherwise identical to the unified barrel scope mount 14 illustrated in FIGS. 1–5 and is mounted in the same way. The round recess 78 only forms a portion of a complete circle. Preferably the round recess 78 extends greater than one half the circumference of a circle. When the unified barrel scope mount 14 is mounted on the barrel 16 of the rifle 10 and the spreader screws 46 are not fully tightened, the unified barrel scope mount 14 may be rotated about the barrel 16 as indicated by the arrow labeled 86. The rotation of the unified barrel scope mount 14 causes the scope mounted therein to also rotate as indicated by the arrow labeled 88. When the scope 12 is rotated to the desired position the spreader screws 46 may be tightened and the scope 12 will be held in its desired position.

The operation of the unified barrel scope mount 14 of the present invention will now be described. In operation, the spreader screws 46 are inserted into the first and second spreader holes 42 and 44 respectively wherein they each engage a thread. The spreader screws 46 are then rotated to extend further into their respective spreader hole 42, 44 until they contact the first wall 45 of the spreader slot 38. Rotation of the spreader screws 46 continues whereby a force is exerted on the first wall 45 causing it to be pushed away from the second wall 47 and causing the first and second walls 45 and 47 to be forced apart thus enlarging the spreader slot 38. Upon expanding the spreader slot 38 to an appropriate size, the mounting section 20 is positioned atop the barrel 16 of the rifle 10 and the spreader screws 46 are removed. If the unified barrel scope mount 14 includes a dovetail recess 32, the mounting section is slid onto the dovetail connector 36 to the desired position along the length of the dovetail connector 36. If the unified barrel scope mount 14 includes a round recess 78, the mounting section may be either slid onto or placed over the barrel 16 and moved to the desired position along the length of the barrel 16. The unified barrel scope mount 14 is positioned on the appropriate connector in either the first or second position based upon the position along the length of the connector 16 or 36 at which the scope is desired. This will allow a greater range through which the scope 12 can be positioned and prevent blocking movement of the bolt 23 and the ejection of shells 76 from the ejection port 64.

Once correctly placed in the desired position, the spreader screws 46 are removed from within the spreader holes 42 and 44 thereby removing the force against the first wall 45 allowing it to return to its original position clamping the connector 16 or 36 of the rifle 10 within the spreader slot 38. The spreader screws 46 are now inserted into the first and second clamping holes 52 and 54. The spreader screws 46 are rotated to extend further into the first and second clamping holes 52 and 54 whereby they are caused to engage the thread therein and extend across the spreader slot 38 securely clamping the unified barrel scope mount 14 to the connector 16 or 36 of the rifle 10.

The scope 12 can now be clamped to the unified barrel scope mount 14 and thus to the rifle 10. The scope 12 is positioned atop the scope mount section 18 within the first and second scope receiving sections 24 and 26. The first and second scope clamping sections are then placed atop the scope 12 whereby the first and second recesses 66 and 68 extending through scope clamping section 28 and 30 are aligned with the recesses 70 and 72 extending through scope receiving sections 24 and 26. A scope clamping screw 74 is then placed within each pair of recesses and turned until the scope clamping screws clamp each scope clamping section 28 and 30 to its respective scope clamping section 28 and 30.

If the unified barrel scope mount 14 includes a round recess 78, the spreader screws 46 may now be turned in a direction so as to loosen them from within the clamping holes 52 and 54. Once loosened, the unified barrel scope mount 14 may now be rotated to place the scope 12 at the desired angle. The spreader screws 46 may now be turned in a direction so as to secure the unified barrel scope mount 14 to the barrel 16.

The unified barrel scope mount 14 is easily removed from the rifle 10 by turning the spreader screws 46 in a direction that removes them. This will act to disengage the spreader screws 46 from their engagement with the thread spiraling within the clamping holes 52 and 54 and release the spreader screws 46 from the first and second clamping holes 52 and 54. The walls 45 and 47 of the mid section 22 may then be separated by inserting the spreader screws 46 into the spreader holes 42 and 44 and turning in a direction in which they will be caused to extend further into their respective spreader holes. This is done in the same manner as described above for expanding the size of the spreader slot 38 for placing the unified barrel scope mount 14 on the connector 16 or 36. The unified barrel scope mount 14 may now be either lifted off the connector 16 or 36 and removed from rifle 10 or slid along the connector 16 or 36 to a more comfortable position.

It is to be understood that the unified barrel scope mount 14 for retaining a scope on one of a rifle and pistol in accordance with the present invention can be made from a single piece of material and may be formed of any suitable material such as steel, iron, any alloy thereof, any alloy of a light weight casted metal, wood, plastic, or any combination of materials and the like and that the invention is not intended to be limited by the materials from which the scope mount is formed.

The present invention is thus able to provide a unified barrel scope mount for rifles and pistols that will overcome the shortcomings of the prior art devices, by producing the unified barrel scope mount 14 including a mounting element for adjustably connecting a scope to the rifle or pistol and is easily positioned and installed on the rifle or pistol. The unified barrel scope mount may be used with both long and standard relief scopes, can be adjusted to sit at any point along the barrel mount and does not interfere with both movement of the bolt and ejection of used shells.

Furthermore, the unified barrel scope mount is simple and easy to use and is also economical in cost to manufacture.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An unified barrel scope mount for retaining a scope on a rifle or pistol, said scope mount comprising:

a) a mounting section for clamping said unified barrel scope mount to the rifle or pistol, said mounting section including a recess formed therein for clamping to a connector on the rifle or pistol;

b) scope mounting means for retaining a scope thereon; and c) separator means connected between said mounting section and said scope mounting means including a slot extending from said recess in said mounting section and at least partially therethrough; a first vertical side extending perpendicular to said slot; and a second diagonal side extending perpendicular to said slot, wherein said unified barrel scope mount is movable along a length of the connector on the rifle or pistol and connectable in one a first position in which the second diagonal side extends over a bolt of the rifle or pistol and a second position in which said second diagonal side extends at least partially over a shell ejection port of the rifle or pistol.

2. The unified barrel scope mount as recited in claim 1, wherein said separator means further includes first and second spreader recesses extending partially therethrough for use in expanding said slot for positioning said unified barrel scope mount on the connector of the rifle or pistol.

3. The unified barrel scope mount as recited in claim 2, wherein said separator means further includes first and second clamping recesses extending therethrough for use in securing said unified barrel scope mount to the connector of the rifle or pistol.

4. The unified barrel scope mount as recited in claim 1, wherein said recess is a dovetail shaped recess for mating with a dovetail shaped connector on the one of the rifle and pistol.

5. The unified barrel scope mount as recited in claim 1, wherein said recess is a semicircular shaped recess for mating with a semicircular shaped connector on the one of the rifle and pistol.

6. The unified barrel scope mount as recited in claim 5, wherein said mounting section includes first and second beveled sides on either side of said semicircular recess.

7. The unified barrel scope mount as recited in claim 1, wherein said slot is defined by first and second walls and said unified barrel scope mount further comprising first and second spreader screws, said first and second spreader screws being inserted within said first and second spreader recesses so as to exert a force on said first wall of said slot causing said first wall to move in a direction away from said second wall thereby increasing the size of said slot upon positioning said unified barrel scope mount on the connector of the one of the rifle and pistol and said first and second spreader screws being inserted within said first and second clamping recesses so as to exert a force on both said first and second walls causing said first and second walls to move towards one another and decrease the size of said slot upon securing said unified barrel scope mount to the connector of the one of the rifle and pistol.

8. The unified barrel scope mount as recited in claim 1, wherein said scope mounting means includes means for retaining a scope therein and means for clamping the scope within said means for retaining.

9. The unified barrel scope mount as recited in claim 8, wherein said scope clamping means is removably connected to said scope retaining means.

10. The unified barrel scope mount as recited in claim 1, wherein said clamping means, scope mounting means and spreader means are all formed from a single piece of material.

11. The unified barrel scope mount as recited in claim 10, wherein said single piece of material is steel, iron, any alloy thereof, any alloy of a light weight casted metal, or any combination thereof.

12. The unified barrel scope mount as recited in claim 11, wherein said single piece of material is wood, plastic, metal or any combination thereof.

13. The unified barrel scope mount as recited in claim 4, wherein said unified barrel scope mount is slideable along a length of the connector on the rifle or pistol.

14. The unified barrel scope mount as recited in claim 6, wherein said unified barrel scope mount is slideable along a length of the connector on the rifle or pistol.

15. The unified barrel scope mount as recited in claim 6, wherein said unified barrel scope mount is rotatable about the connector of the rifle or pistol.

16. The unified barrel scope mount as recited in claim 1, wherein said unified barrel scope mount allows free movement of the bolt of the rifle or pistol.

17. The unified barrel scope mount as recited in claim 1, wherein said unified barrel scope mount allows uninhibited ejection of shells from the ejection port of the rifle or pistol.

18. The unified barrel scope mount as recited in claim 1, wherein said mounting section includes a mounting means.

19. The unified barrel scope mount as recited in claim 1, wherein said mounting means is a camming device.

20. The unified barrel scope mount as recited in claim 1, wherein said mounting means is a toggle.

* * * * *